US006457475B1

(12) United States Patent
Tani et al.

(10) Patent No.: US 6,457,475 B1
(45) Date of Patent: Oct. 1, 2002

(54) CIGARETTE HAVING PROJECTIONS OF AN EMBOSSED PLUG WRAP ATTACHED TO A TIPPING PAPER

(75) Inventors: Shichisei Tani; Toshiaki Okusawa; Kazuhiro Noda, all of Tokyo (JP)

(73) Assignee: Japan Tobacco, Inc., Tokyo (JP)

( * ) Notice: Subject to any disclaimer, the term of this patent is extended or adjusted under 35 U.S.C. 154(b) by 0 days.

(21) Appl. No.: 09/851,339

(22) Filed: May 9, 2001

Related U.S. Application Data

(63) Continuation of application No. PCT/JP99/06211, filed on Nov. 8, 1999.

(30) Foreign Application Priority Data

Nov. 9, 1998 (JP) ..... 10-317867

(51) Int. Cl.[7] ..... A24D 1/02; D21F 11/00; D21H 17/00

(52) U.S. Cl. ..... 131/361; 131/365; 162/139

(58) Field of Search ..... 131/360, 361, 131/365, 335, 336; 162/139; 428/195, 198; 156/60

(56) References Cited

U.S. PATENT DOCUMENTS

| | | | | |
|---|---|---|---|---|
| 3,228,402 A | * | 1/1966 | Lebert | |
| 3,572,347 A | * | 3/1971 | Sherril | |
| 3,596,663 A | * | 8/1971 | Schultz | |
| 4,185,643 A | * | 1/1980 | Riedesser | 131/12 |
| 4,303,080 A | | 12/1981 | Boegli et al. | |
| 4,362,172 A | * | 12/1982 | Johnson | 131/336 |
| 4,492,240 A | * | 1/1985 | Hayes et al. | 131/336 |
| 4,553,556 A | * | 11/1985 | Lephardt | 131/336 |
| 4,582,071 A | * | 4/1986 | Westcott et al. | 131/336 |
| 4,583,560 A | * | 4/1986 | Sakai et al. | 131/336 |
| 4,585,016 A | * | 4/1986 | Grollimund | 131/361 |
| 4,699,158 A | * | 10/1987 | Sprinkel | 131/336 |
| 4,724,848 A | * | 2/1988 | Luke | 131/336 |
| 5,016,656 A | * | 5/1991 | McMurtrie | 131/364 |
| 5,394,895 A | * | 3/1995 | Muramatsu et al. | 131/365 |
| 5,464,028 A | | 11/1995 | Takeda et al. | |
| 6,019,106 A | * | 2/2000 | Okusawa et al. | 131/365 |

FOREIGN PATENT DOCUMENTS

| | | |
|---|---|---|
| EP | A1017794 | 10/1980 |
| JP | A55153589 | 11/1980 |
| WO | A1-9215209 | 9/1992 |

* cited by examiner

*Primary Examiner*—Jose Fortuna
*Assistant Examiner*—Carlos Lopez
(74) *Attorney, Agent, or Firm*—Birch, Stewart, Kolasch & Birch, LLP

(57) ABSTRACT

A filter-tipped cigarette comprises a tobacco rod including a tobacco filler and a tobacco wrapper paper wrapped around the tobacco filler, a filter including a filter member and a filter wrapper paper integrally wrapped around the filter member, and a tip paper sheet having a plurality of apertures arranged along a circumferential direction and connecting the tobacco rod and the filter. The filter wrapper paper has an embossment on substantially an overall surface of the filter wrapper paper. The filter wrapper paper and the tip paper are adhered to each other selectively at projections of the embossment of the filter wrapper paper.

8 Claims, 4 Drawing Sheets

CIGARETTE HAVING PROJECTIONS OF AN EMBOSSED PLUG WRAP ATTACHED TO A TIPPING PAPER

CROSS REFERENCE TO RELATED APPLICATIONS

This is a Continuation Application of PCT Application No. PCT/JP99/06211, filed Nov. 8, 1999, which was not published under PCT Article 21(2) in English.

This application is based upon and claims the benefit of priority from the prior Japanese Patent Application No. 10-317867, filed Nov. 9, 1998, the entire contents of which are incorporated herein by reference.

BACKGROUND OF THE INVENTION

The present invention relates to a filter-tipped cigarette and more particularly to an improvement of a plug wrapper for providing cigarettes that exhibit a small variations in ratio of air flowing into a cigarette through a filter (filter ventilation ratio: hereinafter referred to as "Vf").

A conventional filter-tipped cigarette is constituted by a tobacco rod and a filter that are connected by a so-called tip paper. The cigarette filter is formed by wrapping a wrapper paper around fibrous filter material, such as cellulose diacetate fibers, into a cylindrical shape. In recent years, in order to reduce the amount of a smoke component flowing into the mouth through a mouthpiece end of the filter, means is frequently used which causes air to flow in through the side surface of the filter, by combining a filter plug wrapper having an air permeability with a tip paper which is apertures by means of static electricity, a laser or the like. In such a filter with apertures, diluting air flows in through the peripheral portion of the filter into the mouth of a smoker while tobacco smoke is introduced through the central portion of the filter. Thus, the amount of the smoke component introduced into the mouth as a whole is reduced.

In the conventional cigarette described above, it has been confirmed that even where the filter plug wrapper and the tip paper are formed of the same material, large variations in the Vf value occurs. Since the Vf value is greatly correlated with the amount of the smoke component, these variations are not preferable.

Accordingly, an object of the present invention is to provide a filter-tipped cigarette that can suppress the variations of the Vf value and stably supply a reduced amount of a smoke component.

BRIEF SUMMARY OF THE INVENTION

The applicant has disclosed in Jpn. Pat. Appln. KOKAI Publication No. 6-90728 (corresponding to U.S. Pat. No. 5,464,028) that in a filter-tipped cigarette comprising a tobacco rod and a filter connected by a tip paper having air-permeating holes (ventilation apertures), the variations of Vf values correlate with adhesion between the filter wrapper paper and the tip paper, irrespective of the air permeability of the materials, such as the filter wrapper paper, which is wrapped around the filter member. To improve the filter wrapper paper, the adhesion has been alleviated by embossing the filter wrapper paper which is wrapped around the filter member, so that the variations of the Vf values can be reduced.

Based on the above findings, the present inventors made further studies to more stabilize the Vf values. As a result, they discovered that the Vf values can be more stabilized by adhering an embossed filter wrapper paper to a tip paper only at projected portions of the embossment, accomplishing the present invention.

Thus, according to the present invention, there is provided a filter-tipped cigarette comprising: a tobacco rod including a tobacco filler and a tobacco wrapper wrapped around the tobacco filler; a filter including a filter member and a filter wrapper paper integrally wrapped around the filter member; and a tip paper sheet having a pluraliy of apertures arranged along a circumferential direction and connecting the tobacco rod and the filter, the filter wrapper paper having an embossment on substantially an entire surface thereof, and the filter wrapper paper and the tip paper sheet being adhered to each other selectively at projections of the embossment of filter wrapper paper.

In the present invention, the filter wrapper paper and the tip paper can be adhered except for a region where the plurality of apertures are formed. Further, in the present invention, it. is preferable that the embossment have a depth of 10 to 100 $\mu$m, and the embossment have a pitch of 100 to 3000 $\mu$m.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
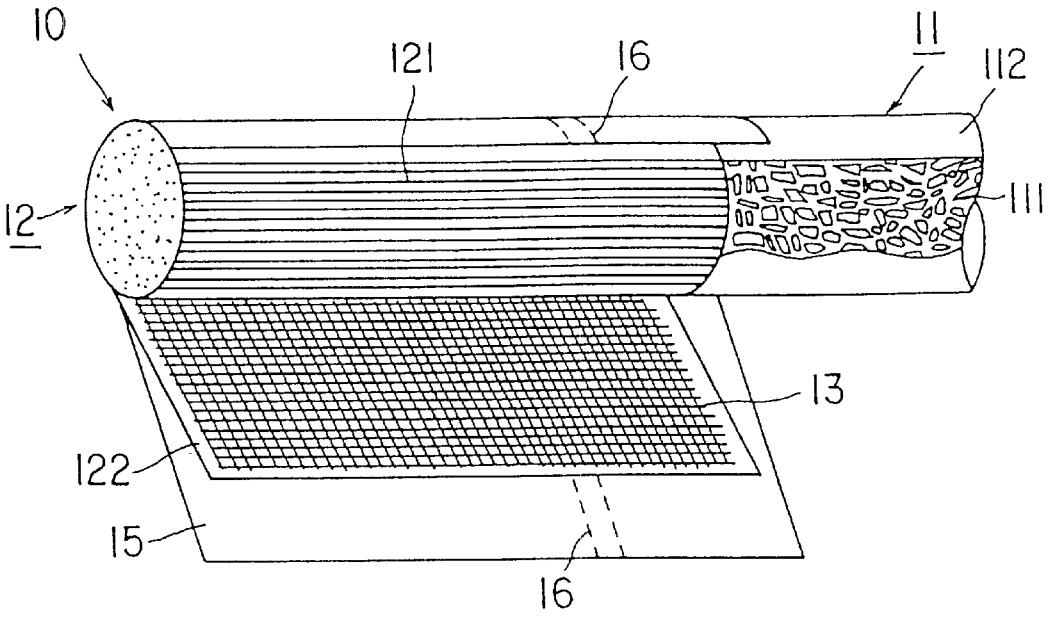
FIG. 1 is a partially exploded perspective view showing a filter-tipped cigarette according to a first embodiment of the present invention.

The present invention will now be described in detail with reference to the drawings. The same or similar elements are identified by the same reference numerals throughout the drawings.

FIG. 1 is a partially exploded perspective view showing a filter-tipped cigarette according to a first embodiment of the present invention. The filter-tipped cigarette 10 shown in FIG. 1 comprises a tobacco rod 11 and a filter 12, and has a cylindrical shape as a whole, like the usual filter-tipped cigarette. The tobacco rod 11 and the filter 12 are connected by a tip paper 15.

Like the usual cigarette, the tobacco rod 11 is formed of a tobacco filler 111 and a tobacco wrapper 112 wrapping the periphery of the filler. The tobacco rod may have a diameter of 5 to 10 mm and a length of 40 to 80 mm, for example.

The filter 12 is located at an end of the tobacco rod, and comprises a filter member 121 and a filter wrapper paper 122 wrapped around the filter member. The filter member 121 shown in FIG. 1 has a single, so-called plane, filter structure. As in the usual filter-tipped cigarette, the filter member is constituted by a fibrous filter material such as cellulose acetate fibers. The diameter of the filter 12 is substantially the same as that of the tobacco rod 11 and its length may be, for example, 15 to 40 mm like the usual filter.

The filter wrapper paper 122 integrally wrapped around the filter member 121 preferably has a high air permeability of CORESTA permeability of 1000 or higher, and may be as thick as 10 to 100 $\mu$m. Substantially the overall surface of the filter wrapper paper 122 has an embossment 13 as will be described later in detail.

The tip paper sheet 15 covers the entire of the filter wrapper paper 122 and a portion of the tobacco wrapper 112. The tip paper 15 may have a length in the axial direction of the cigarette (width) of 20 to 50 mm and a thickness of 10 to 100 $\mu$m. The tip paper 15 has a number of small apertures for air permeation (ventilation apertures) 16 arranged in one or a plurality of lines (two lines in FIG. 1) or irregularly along the circumferential direction of the cigarette. The apertures 16 of the tip paper 15 can be formed by conventional means, such as static electricity or a laser. The ventilation apertures 16 may be formed either before or after the tip paper 15 is adhered to the filter wrapper paper 122.

Figure 2:
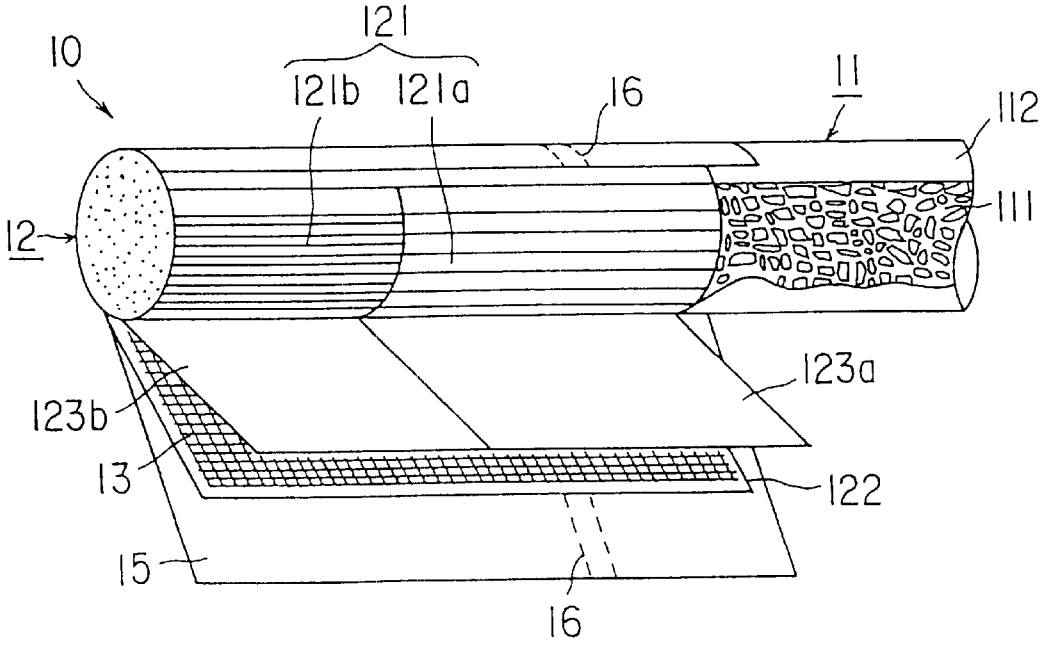
FIG. 2 is a partially exploded perspective view showing a filter-tipped cigarette according to a second embodiment of the present invention.

FIG. 2 is a partially exploded perspective view showing a filter-tipped cigarette according to a second embodiment of the present invention. In FIG. 2, the elements corresponding to those shown in FIG. 1 are identified by the same reference numerals as those used in FIG. 1, and explanations thereof will be omitted.

The filter-tipped cigarette shown in FIG. 2 has a so-called dual filter structure, in which the filter member 121 is constituted by a first filter section 121*a* and a second filter section 121*b*,each made of fibrous filter material, such as cellulose acetate fibers. Each of the first filter section 121*a* and the second filter section 121*b* may have a length of, for example, 5 to 20 mm, and the sum of the lengths may be, for example, 15 to 40 mm. In the filter member 121 of the dual filter structure, the first filter section 121*a* may be a so-called charcoal filter in which activated carbon is dispersed therein.

The first and second filter sections 121*a* and 121*b* are individually wrapped sufficiently by a first individual filter wrapper paper 123*a* and a second individual filter wrapper paper 123*b* separate from each other (these individual wrapper may be collectively denoted by 123 hereinafter). It is preferable that each of the individual filter wrapper papers 123 have a permeability of 1000 CORESTA units or higher. The thickness of the filter wrapper papers 123 may be 10 to 100 $\mu$m. The first and second filter sections 121*a* and 123*b* wrapped by the individual filter wrapper papers 123*a* and 123*b* are collectively wrapped by a filter wrapper paper 122 having an embossment 13 as in the case of the cigarette shown in FIG. 1.

Both in the filter-tipped cigarettes shown in FIGS. 1 and 2, the filter wrapper paper 122 integrally wrapped around the filter member 121 has the embossment 13 preferably having a lattice concave (groove) pattern.

Figure 3A:
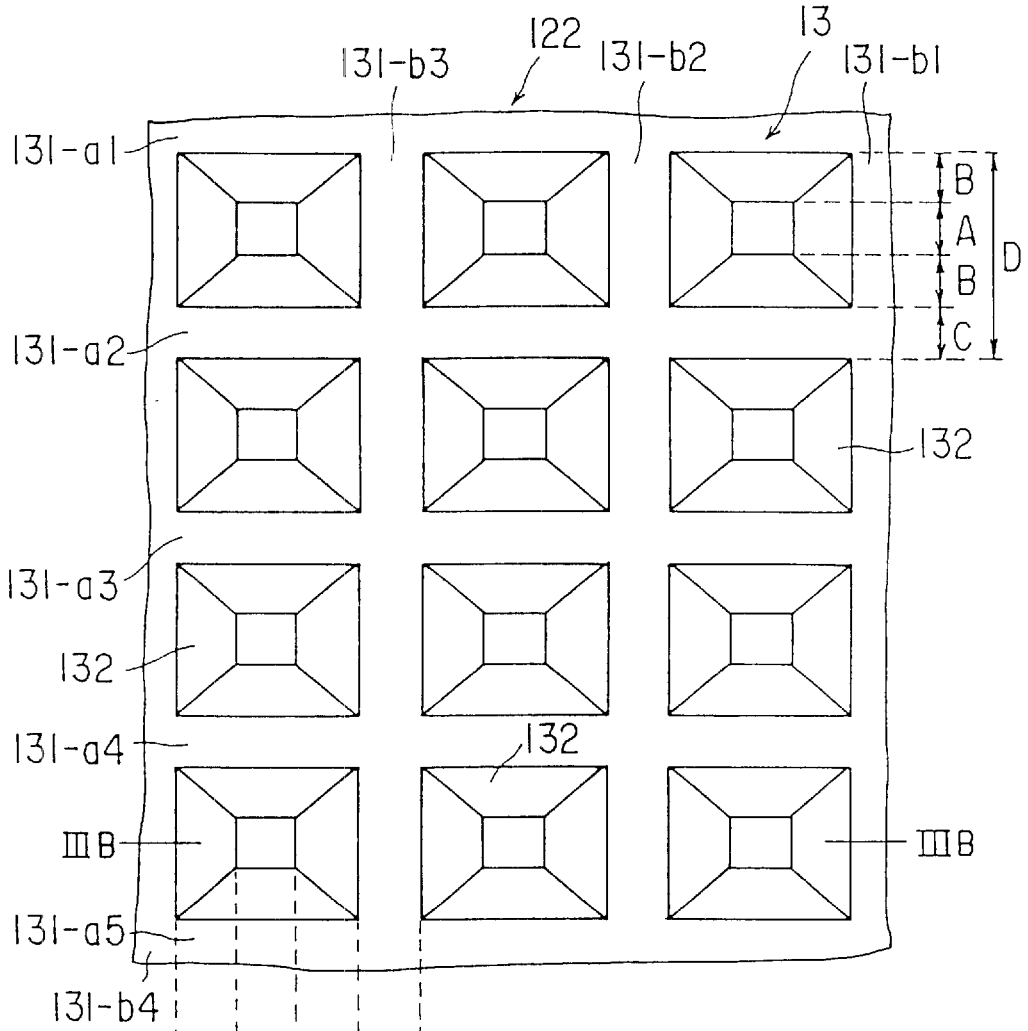
FIG. 3A is an enlarged plan view partially showing an exploded filter wrapper paper for use in the present invention.
Figure 3B:
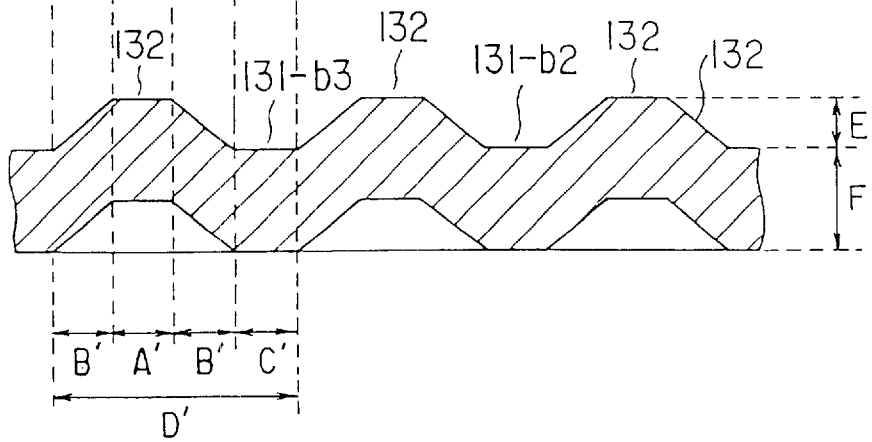
FIG. 3B is a cross-sectional view taken along the line IIIB—IIIB in FIG. 3A.

FIGS. 3A and 3B are diagrams showing a part of an example of the filter wrapper paper 122 having the embossment 13. FIG. 3A is an enlarged plan view and FIG. 3B is an enlarged cross-sectional view taken along the line IIIB—IIIB in FIG. 3A.

The embossment 13 applied to the filter wrapper paper 122 shown in FIGS. 3A and 3B has a rectangular lattice (square lattice or rectangular lattice) groove pattern. It is formed on the entire surface of the filter wrapper paper 122. The embossment 13 is formed by embossing by means of a knurling member or the like. FIGS. 3A and 3B show grooves 131-*a*1 to 131-*a*5 extending parallel to each other in a left-right direction of the drawings (hereinafter referred to also as a "horizontal" direction, which may be, for example, substantially perpendicular to the direction of arrangement of the ventilation apertures 16 of the tip paper sheet 15). Also shown are grooves 131-*b*1 to 131-*b*4 extending parallel to each other and in a direction perpendicular to the grooves 131-*a*1to 131-*b* (hereinafter referred to also as "vertical direction"). Each of the regions defined by the grooves 131-*a*1to 131-*a*5 and 131-*b*1 to 131-*b*4 constitutes a projection 132 projected as a prismoid, which is rectangular in a plan view.

Preferable dimensions of the embossment 13 including the thickness of the filter wrapper paper 122 will be described. Referring to FIGS. 3A and 3B, A denotes the length of a substantially flat top surface of the projection 132 along the vertical direction; A' the length thereof along the horizontal direction; B the distance between the bottom edge of the projection 132 and the top surface edge thereof along the vertical direction; B' the distance between the bottom edge of the projection 132 and the top surface edge thereof along the horizontal direction; C the width of the groove extending along the horizontal direction; C' the width of the groove extending along the vertical direction; D the embossment pitch along the vertical direction (A+2B+C); D' the embossment pitch along the horizontal direction (A'+2B'+C'); E the depth of each groove (the depth of the embossment); and F the thickness of the filter wrapper paper 122 (before embossing). In this case, preferable dimensions fall within the following ranges:

A and A': 30–1000 $\mu$m (each)
B and B': 30–1000 $\mu$m (each)
C and C': 30–1000 $\mu$m (each)
D and D': 100–3000 $\mu$m (each)
E: 10–100 $\mu$m
F: 10–100 $\mu$m According to the present invention, in particular, if the embossment is too shallow, an expected effect cannot be obtained. If it is too deep, a defect (defect in adhesion of the filter wrapper paper 122 and the tip paper sheet) may be caused in tobacco making by a tobacco-making machine. In the present invention, as indicated above, the depth of the embossment is preferably 10–100 $\mu$m (0.01–0.1 mm), more preferably 30–60 $\mu$m (0.03–0.06 mm). the depth of the embossment can be measured by a pin-sensing three-dimensional roughness tester (for example, SE-3AK produced by Kosaka Laboratory).

Further, in the present invention, if the embossment pitch is too large, the groove may be filled with an adhesive and an expected effect cannot be obtained. As indicated above, the embossment pitch is preferably, 100–3000 $\mu$m (0.1–3 mm), more preferably 300–1000 $\mu$m (0.3–1 mm).

Figure 4:
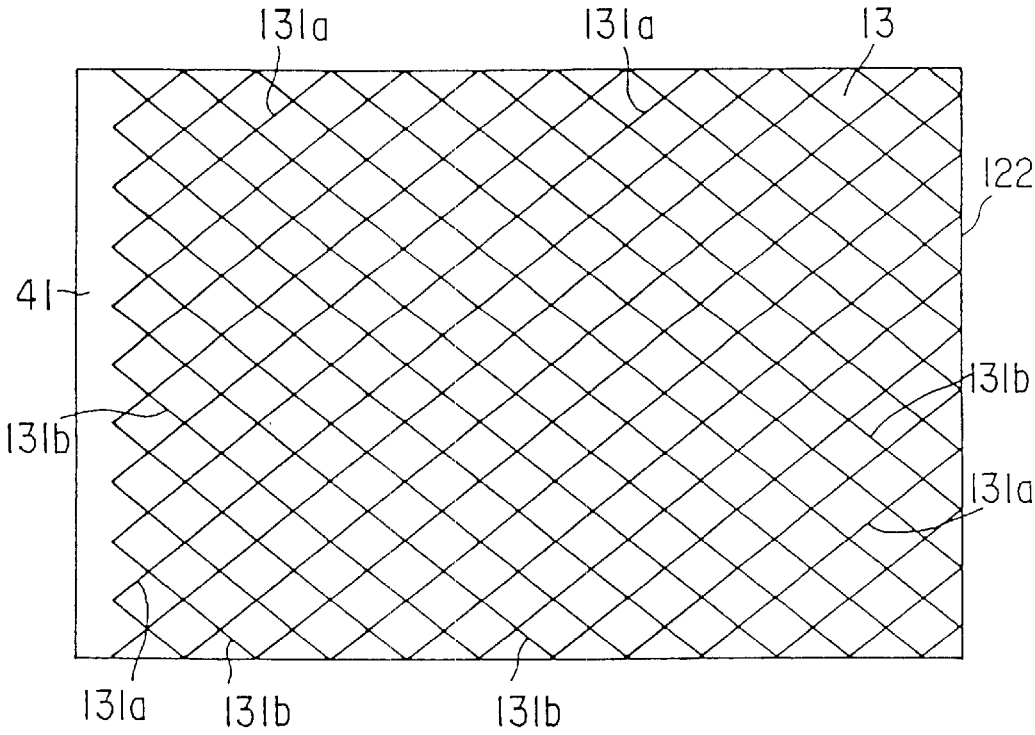
FIG. 4 is a schematic plan view of another exploded filter wrapper paper for use in the present invention.

FIG. 4 is a plan view of a filter wrapper paper 122 with an embossment 13 having an oblique lattice groove pattern.

In the embossment shown in FIG. 4, the width of a groove 131*a* and a groove 131*b* diagonally extending across the groove 131*a*, the depth (depth of the embossment) and the embossment pitch are the same as those described above with reference to FIGS. 3A and 3B. As clearly shown in FIG. 4, in this invention, the embossment 13 need not be formed in a adhering portion 41 at which end portions of the filter wrapper paper 122 are adhered together.

Figure 5:
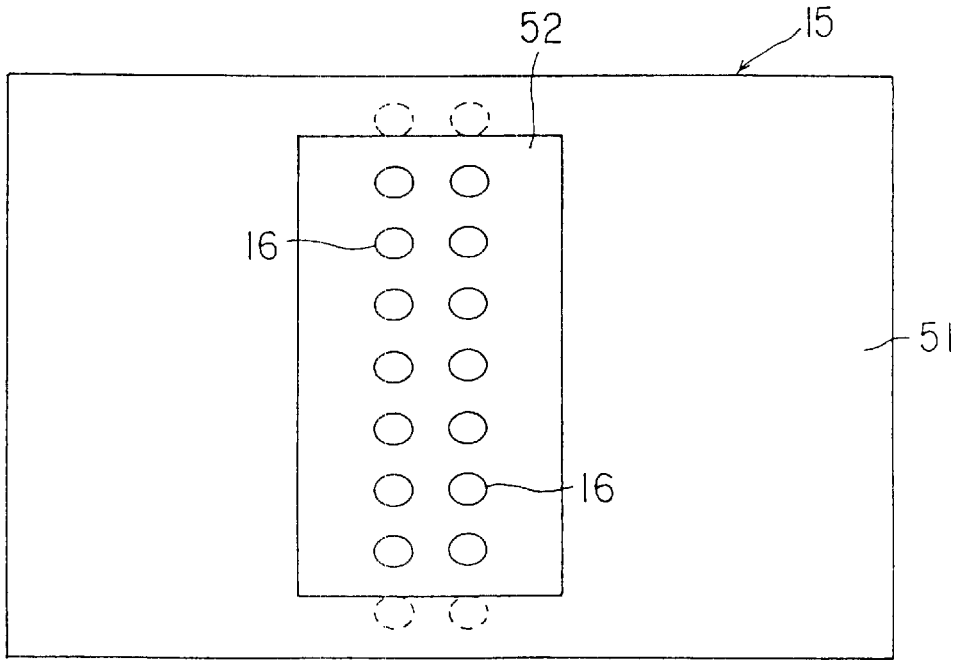
FIG. 5 is a schematic plan view for explaining application of an adhesive to a tip paper for use in the present invention.
Figure 6:
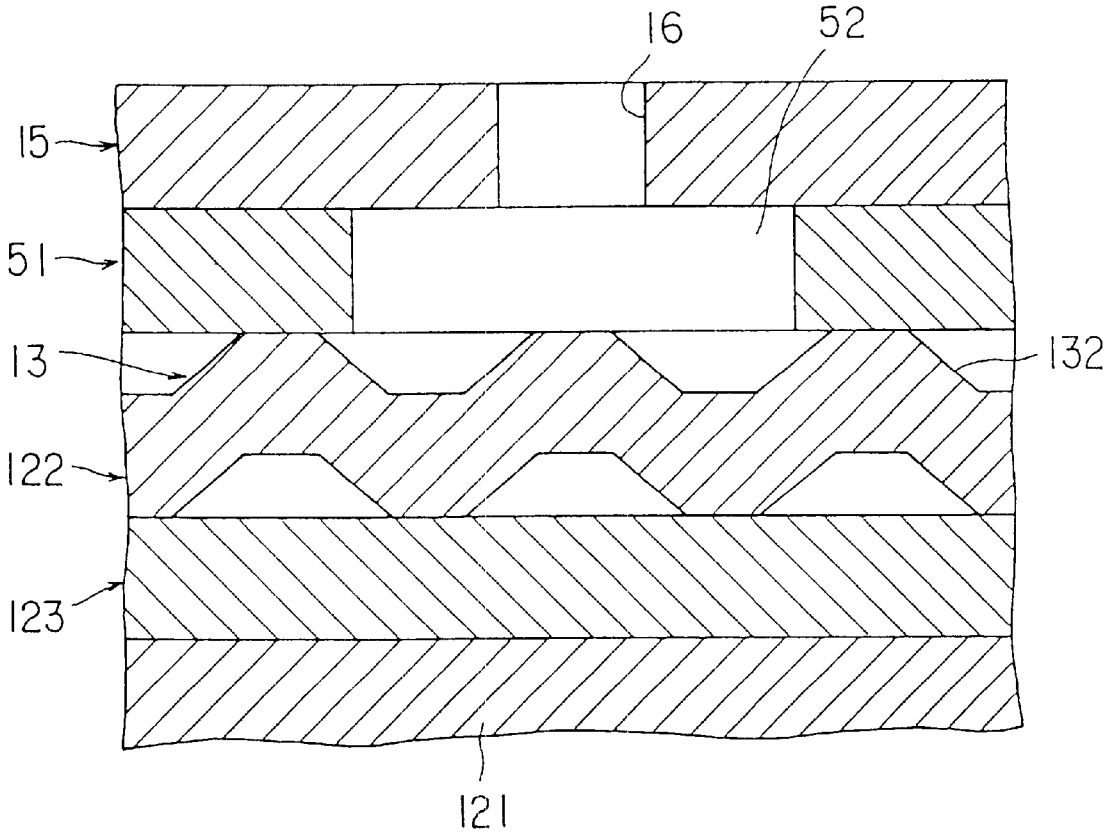
FIG. 6 is an enlarged schematic cross-sectional view of a filter portion and a tip paper sheet of a filter-tipped cigarette of the present invention.

In the present invention, the filter wrapper paper and the tip paper may be adhered together substantially excluding a ventilation aperture-forming region of the tip paper. In this case, for example, as shown in FIG. 5, an adhesive 51 is applied to all rear surface of the tip paper sheet 15 except for a region 52 where the ventilation apertures 16 of the tip paper 15 are formed. More specifically, in this case, the filter wrapper paper and the tip paper are adhered together selectively at projections (that is, only at projections) of the embossment of the filter wrapper paper in a portion substantially excluding the ventilation aperture-forming region of the tip paper sheet. In other words, as exaggeratedly shown in FIG. 6, the filter wrapper paper 122 having the embossment 13 and the tip paper having the ventilation apertures 16, which collectively cover the individual filter wrapper paper 123 wrapped around the filter member 121, can be adhered to each other by the adhesive layer 51 only at the top surfaces of the projections 132 of the embossment in the region excluding the ventilation aperture 16-forming region 52 (spot gluing). As described before with reference to FIG. 5, the adhesive 51 can be applied to substantially all region except for the ventilation aperture 16-forming region 52. However, on the side of the filter wrapper paper 122, the adhesive is brought into contact with only the projections of the embossment 13 (point contact). Depending on the method for forming ventilation apertures, the adhesive can be applied also over the ventilation aperture-forming region.

The adhesive 51 for adhering the filter wrapper paper 122 and the tip paper 15 may be mainly composed of polyvinyl acetate or an ethylene/vinyl acetate copolymer as conventionally used. To achieve the above spot gluing, it is preferable that the viscosity of the adhesive at its application. be at least 500 cPs, more specifically, 500 to 5000 cPs, and particularly preferably, 500 to 3000 cPs (measured by a BL-type rotating viscometer using the rotor No. 3 at 30 rpm and 30° C.).

Owing to the above structure, in the filter-tipped cigarette of the present invention, the adhesion between the filter wrapper paper 122 and the tip paper sheet 15 is alleviated by the embossment 13, thereby improving the air permeability through the ventilation apertures 16 to the filter wrapper paper 122. In addition, since the filter wrapper paper 122 and the tip paper 15 are adhered by spot gluing, a gas passage from the region 52 at which the ventilation apertures 16 are formed (ventilation region) to the mouthpiece end of the filter 12 is constituted by a concave (groove) of the embossment 13. A part of the diluting air flowing in from the ventilation apertures 16 of the tip paper 15 flows through the gas passage via the ventilation region 52. The other part thereof passes the filter wrapper paper 122 via the ventilation region 52 and flows into the filter member 121. On the other hand, a part of mainstream smoke of the tobacco is passed through the gas passage from the tip end of the filter member 121 (the end opposite to the mouthpiece end). It is pushed by the part of the diluting air flowing in via the ventilation region 52 and passed through the filter wrapper paper 122, and joins the other part of the mainstream smoke which has passed through the filter member 121 from the tip end. Thus, in the filter-tipped cigarette of the present invention, the Vf value can be large and the variations thereof can be small.

EXAMPLE 1

The embossment 13 having a square lattice groove pattern (see FIGS. 3A and 3B) is formed on the overall filter wrapper paper 122 except for a adhering portion. This filter wrapper paper 122 was used to prepare filter-tipped cigarettes (the overall length: 84 mm, the circumference: 25 mm) having the dual structure as shown in FIG. 2 to meet the following specifications. The filter wrapper paper and the tip paper were adhered by a vinyl acetate-based adhesive (the viscosity: 1000 cPs).

Specification of the Cigarettes

<Tobacco Rod 11>
- Air permeation resistance: 80 $mmH_2O$

<Filter 12>
- Conventional dual filter
- Length: 25 mm
  - Individual filter wrapper paper 123
    - Air Permeability: 10000 CORESTA units
  - Filter wrapper 122
    - Air Permeability: 2000 CORESTA unit
    - Embossing of a square lattice groove pattern
    - Embossment depth: 40 $\mu$m
    - Embossment pitch: indicated in Table 1

<Tip paper sheet 15>
- Lasered apertures (ventilation apertures 16) in 2 lines
- Air Permeability: 1000

100 samples of each of the above cigarettes were prepared and set to a ventilation meter. Then the filter ventilation ratio of each sample was measured. In the cigarettes of the present invention with the filter wrapper paper 122 having the embossment, it was observed that the filter wrapper paper 122 and the tip paper were adhered by spot gluing. However, in the comparative samples with a filter wrapper paper having no embossment, they were adhered by overall gluing.

The results are indicated in Table 1. In the table, Ave denotes an average value of the filter ventilation ratio, SD denotes a standard deviation, and CV denotes a coefficient of variation represented by the following equation: CV=(SD/Ave)×100(%) (the same applies to the subsequent examples).

TABLE 1

The relationship between the embossment pitch and Vf

| | Embossment Pitch (mm) | | | |
|---|---|---|---|---|
| | No embodiment | 2.1 | 1.06 | 0.64 |
| Ave (%) | 32.2 | 43.0 | 49.2 | 54.9 |
| SD (%) | 2.3 | 2.7 | 2.9 | 2.9 |
| CV (%) | 7.1 | 6.3 | 5.9 | 5.3 |

As shown in Table 1, it was observed that the ventilation ratio was improved and variations in the filter ventilation ratio were smaller in the samples according to the present invention as compared to the comparative sample having no embossment. In particular, it is understandable that the smaller the embossment pitch, the smaller the variations in Vf value.

EXAMPLE 2

Filter-tipped cigarettes as indicated in the following Tables 2 to 4 were prepared in the same manner as in the case of Example 1, except that the embossment pitch was set to 2.1 mm or 0.64 mm and the embossment depth was varied. Then, the Vf values of the these cigarettes were measured. In the cigarettes of the present invention with the filter wrapper paper 122 having the embossment, it was observed that the filter wrapper paper 122 and the tip paper were adhered by spot gluing. However, in the comparative samples with filter wrapper paper having no embossment, they were adhered by overall gluing.

The results are indicated in Tables 2 to 4.

TABLE 2

| | the relationship between the embossment depth and Vf in the case where embossment pitch is 2.1 mm | | | | | |
|---|---|---|---|---|---|---|
| | Embossment Depth (μm) | | | | | |
| | No embossment | 25 | 34 | 44 | 47 | 53 |
| Ave (%) | 31.4 | 37.0 | 38.6 | 42.2 | 43.2 | 44.2 |
| SD (%) | 3.2 | 3.0 | 2.5 | 2.3 | 2.6 | 2.3 |
| CV (%) | 10.2 | 8.1 | 6.5 | 5.5 | 6.0 | 5.2 |

TABLE 3

| | the relationship between the embossment depth and Vf in the case where embossment pitch is 0.64 mm | | | | | |
|---|---|---|---|---|---|---|
| | Embossment Depth (μm) | | | | | |
| | No embossment | 18 | 23 | 26 | 40 | 47 |
| Ave (%) | 33.1 | 44.5 | 46.8 | 49.2 | 54.0 | 57.9 |
| SD (%) | 3.5 | 3.2 | 3.2 | 2.9 | 2.9 | 2.4 |
| CV (%) | 10.6 | 7.2 | 6.8 | 5.9 | 5.3 | 4.1 |

TABLE 4

| | the relationship between the embossment depth and Vf in the case where embossment pitch is 0.64 mm | | | | | |
|---|---|---|---|---|---|---|
| | Embossment Depth (μm) | | | | | |
| | No embossment | 17 | 24 | 28 | 36 | 46 |
| Ave (%) | 32.6 | 45.4 | 49.0 | 52.0 | 54.6 | 59.2 |
| SD (%) | 3.8 | 3.3 | 3.4 | 2.8 | 2.4 | 2.5 |
| CV (%) | 11.7 | 7.3 | 6.9 | 5.4 | 4.4 | 4.2 |

As shown in Tables 2 to 4, it was observed that the ventilation ratio was improved and variations in the filter ventilation ratio were smaller in the samples according to the present invention as compared to the comparative samples having no embossment.

As has been described above, the present invention can decrease the variations of the Vf values as well as improve Vf of the filter-tipped cigarette. In other words, the filter ventilation of the cigarette can be controlled reliably. Thus, it is possible to stably provide a desired amount of a smoke component.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A filter-tipped cigarette comprising:

a tobacco rod including a tobacco filler and a tobacco wrapper paper wrapped around the tobacco filler;

a filter including a filter member and a filter wrapper paper integrally wrapped around the filter member; and a tip paper having a plurality of apertures arranged along a circumferential direction thereof, and connecting the tobacco rod and the filter, the filter wrapper paper having an embossment on substantially an entire surface thereof, and the filter wrapper paper and the tip paper being adhered to each other by spot gluing at projections of the embossment of the filter wrapper paper.

2. The filter-tipped cigarette according to claim 1, wherein the filter wrapper paper and the tip paper are adhered except for a region where the plurality of apertures are formed.

3. The filter-tipped cigarette according to claim 1, wherein the embossment has a depth of 10 to 100 μm.

4. The filter-tipped cigarette according to claim 2, wherein the embossment has a depth of 10 to 100 μm.

5. The filter-tipped cigarette according to claim 1, wherein the embossment has an emboss pitch of 100 to 3000 μm.

6. The filter-tipped cigarette according to claim 2, wherein the embossment has a pitch of 100 to 3000 μm.

7. The filter-tipped cigarette according to claim 3, wherein the embossment has an emboss pitch of 100 to 3000 μm.

8. The filter-tipped cigarette according to claim 4, wherein the embossment has an emboss pitch of 100 to 3000 μm.

* * * * *